US005819774A

United States Patent [19]

Beardsley et al.

[11] Patent Number: 5,819,774

[45] Date of Patent: Oct. 13, 1998

[54] SELF-LUBRICATING AND WEAR RESISTANT VALVE/VALVE GUIDE COMBINATION FOR INTERNAL COMBUSTION ENGINES

[75] Inventors: M. Brad Beardsley, Laura; Karen R. Raab, Chillicothe, both of Ill.

[73] Assignee: Caterpillar Inc., Peoria, Ill.

[21] Appl. No.: 704,194

[22] Filed: Aug. 28, 1996

[51] Int. Cl.[6] ..... E03B 1/00

[52] U.S. Cl. ..... 137/1; 251/368; 251/355

[58] Field of Search ..... 251/368, 355; 137/1, 375; 427/448, 450, 451, 456, 576, 577, 422, 427, 357, 405, 419.7, 255.7, 239, 237, 249, 250

[56] References Cited

U.S. PATENT DOCUMENTS

| | | | |
|---|---|---|---|
| 4,546,737 | 10/1985 | Kazuoka et al. | 251/368 |
| 4,597,367 | 7/1986 | Hayashi | 251/368 |
| 4,763,876 | 8/1988 | Oda et al. | 251/368 |
| 4,787,736 | 11/1988 | Mori et al. | 251/368 |
| 5,069,422 | 12/1991 | Kawamura | 251/368 |
| 5,517,956 | 5/1996 | Jette et al. | 251/368 |

*Primary Examiner*—Denise L. Ferensic
*Assistant Examiner*—John Ball
*Attorney, Agent, or Firm*—Kevin M. Kercher

[57] ABSTRACT

A self-lubricating and wear resistant valve/valve guide combination for an engine includes a self-lubricating coating deposited on one of (a) the inner surface of the valve guide, or (b) the outer surface of the valve stem. A wear-resistant coating deposited on one of (a) the outer surface of the valve stem when the self-lubricating coating is deposited on the inner surface of the valve guide, or (b) the inner surface of the valve guide when the self-lubricating coating is deposited on the outer surface of the valve stem. The self-lubricating coating has a composition, by weight, consisting essentially of, (a) a first component, comprising, a metal-bonded chromium carbide in the range of about 60% to about 80%, (b) a second component, comprising, a soft noble metal in the range of about 1% to about 20%, and (c) a third component, comprising, a metal fluoride eutectic in the range of about 5 to about 20%. The wear-resistant coating has a composition, by weight, consisting essentially of, (a) chromium in the range of about 20% to about 30%, (b) nickel in the range of about 5% to about 15%, (c) tungsten in the range of about 1% to about 10%, and (d) cobalt in the range of about 50% to about 74%.

25 Claims, 3 Drawing Sheets

SELF-LUBRICATING AND WEAR RESISTANT VALVE/VALVE GUIDE COMBINATION FOR INTERNAL COMBUSTION ENGINES

TECHNICAL FIELD

The present invention relates to valves and valve guides for internal combustion engines and more particularly, to a self-lubricating and wear-resistant valve and valve guide combination having a low valve stem-to-guide clearance and reduced emission.

BACKGROUND ART

A typical valve assembly for use in an internal combustion engine has a valve, a valve spring to press the valve to a closed position, a valve spring retainer for transmitting a pressure off the spring to the valve, and a valve guide to hold the valve stem in position within the valve guide bore during the reciprocating motion of the valve stem. Such valve mechanisms used in internal combustion engines are well known in the industry. During the operation of the valve assembly, the valve stem is moved very rapidly, for extended periods of time, in a reciprocating motion within the valve guide. Every valve assembly is for an intake and/or exhaust valve for an engine. The valve stem reciprocates within the valve guide so as to open and close periodically to comply with the timing of the valve with the revolution of the engine. When the valve assembly is used in a turbocharger wastegate, the valve stem reciprocates within the valve guide to open and close periodically to release the excess exhaust gas pressure. Thus, the outer surface of the valve stem slides on the inner surface of the valve guide at a very high speed and an abrasion load is repeatedly applied to the contact surface of the valve stem. Consequently, over a period of time, both the surfaces of the valve stem and the valve guide are abraded.

In order to control and minimize this abrasion, many researchers have realized advantages by coating the surfaces of the valve stem and the valve guide with various metal and ceramic alloys. For example, U.S. Pat. No. 5,300,364, issued on Dec. 6, 1994 to Kenmoku et al., discloses an engine valve shaft coated with a titanium alloy. In conventional practice, valve stem/valve guide assemblies are generally lubricated by oil. This oil is provided to the valve guide/valve stem assembly by splash lubrication of the area. To further improve the oil lubrication in this assembly, the valve guide is knurled on the inner surface to provide lubricant retention. This knurling of the inner surface of the valve guide causes several problems. The oil in the valve stem/valve guide assembly can enter the exhaust stream and contribute to volatile emissions such as hydrocarbons and other organic particulate. Further, due to the increased combustion pressures in advanced engine designs, such as for example, low heat rejection engines, the oil is frequently not retained in the valve guide even though the valve guide is knurled. This loss of oil results in decreased lubrication consequently resulting in the wear of the valve stem and the valve guide. Further, the knurling of the valve guide inner surface results in the effective valve stem to valve guide radial clearance to become as high as in the range of 0.01 inch to 0.015 inches. This excessive clearance is detrimental to the retention of high combustion pressures due to increased compression ratios in advanced engines.

It has been desirable to have a valve stem/valve guide assembly for use in engines wherein the valve stem to guide radial clearance is very low, preferably in the range of 0.001 to 0.004 inches, so as to help in the retention of high combustion pressures. It has further been desirable to have a self lubricating valve stem/valve guide assembly to preclude the use of external oil lubrication for the valve guide/valve stem assembly. It has still further been desirable to have a valve stem/valve guide assembly that wherein the valve guide is not knurled but rather a smooth bore so as to allow a low valve stem to guide radial clearance and thus reduce the oil entering the exhaust stream and thus prevent excessive emissions into the atmosphere. It has yet further been desirable to have a combination of self lubricating and wear resistant coatings on respective valve stem and valve guide surfaces that slide against each other so as to not only provide adequate lubrication but also improve wear resistance, particularly at high temperatures found in advanced diesel engine designs and natural gas engine designs and turbocharger wastegates.

The present invention is directed to overcome one or more of the problems in the heretofore valve/valve guide designs as set forth above.

DISCLOSURE OF THE INVENTION

In one aspect of the invention, a self-lubricated and wear resistant valve/valve guide combination for an engine comprises a valve guide having a tubular shape and an inner surface. The valve/valve guide further comprises a valve having a valve stem. The valve stem has an outer surface. A self-lubricating coating is deposited on one of (a) the inner surface of the valve guide, or (b) the outer surface of the valve stem. A wear-resistant coating is deposited on one of (a) the outer surface of the valve stem when the self-lubricating coating is deposited on the inner surface of the valve guide, or (b) the inner surface of the valve guide when the self-lubricating coating is deposited on the outer surface of the valve stem. The self-lubricating coating has a self-lubricating surface and the wear-resistant coating has a wear-resistant surface. The self-lubricating coating has a composition, by weight, consisting essentially of, (a) a first component, comprising, a metal-bonded chromium carbide in the range of about 60% to about 80%, (b) a second component, comprising, a soft noble metal in the range of about 1% to about 20%, and (c) a third component, comprising, a metal fluoride eutectic in the range of about 5% to about 20%. The wear-resistant coating has a composition, by weight, consisting essentially of, (a) chromium in the range of about 20% to about 30%, (b) nickel in the range of about 5% to about 15%, (c) tungsten in the range of about 1% to about 10%, and (d) cobalt in the range of about 50% to about 74%.

In another aspect of the present invention, a method of forming a self-lubricated and wear resistant valve/valve guide combination for an engine is disclosed. A metal mandrel is provided. A first coating on is deposited on the mandrel. The first coating is selected from one of (a) a self-lubricating coating, or (b) a wear-resistant coating. The self-lubricating coating has a composition, by weight, consisting essentially of, (a) a first component, comprising, a metal-bonded chromium carbide in the range of about 60% to about 80%, (b) a second component, comprising, a soft noble metal in the range of about 1% to about 20%, and (c) a third component, comprising, a metal fluoride eutectic in the range of about 5% to about 20%. The wear-resistant coating has a composition, by weight, consisting essentially of, (a) chromium in the range of about 20% to about 30%, (b) nickel in the range of about 5% to about 15%, (c) tungsten in the range of about 1% to about 5%, and (d) cobalt in the range of about 50% to about 74%. The metal mandrel and a portion of the first coating is machined and a valve guide is formed. The valve guide has a tubular shape and an inner surface of the first coating. The inner surface is free of knurling. A valve having a valve stem is also provided. The valve stem has an outer surface. A second coating is deposited on the outer surface of the valve stem. The second coating is selected from one of (a) a wear-resistant coating when the first coating is the self-lubricating coating, or (b) a self-lubricating coating when the first coating is the wear-resistant coating. The valve stem is located within the valve guide. A valve/valve guide combination having a valve stem-to-guide clearance in the range of about 0.04 mm (0.00157 inch) to about 0.08 mm (0.003 inch) is formed.

In yet another aspect of the present invention, a method of using a combination of a self-lubricating coating and a wear-resistant coating in a valve and valve guide for an engine is disclosed. A valve guide having a tubular shape and an inner surface free of knurling is provided. A valve having a valve stem and an outer surface is also provided. A first coating is plasma sprayed on the inner surface of the valve guide. The first coating is selected from one of (a) a self-lubricating coating, or (b) a wear-resistant coating. A second coating is plasma sprayed on the outer surface of the valve stem. The second coating is selected from one of (a) a wear-resistant coating when the first coating is the self-lubricating coating, or (b) a self-lubricating coating when the first coating is the wear-resistant coating.

BEST MODE FOR CARRYING OUT THE INVENTION

Figure 1:
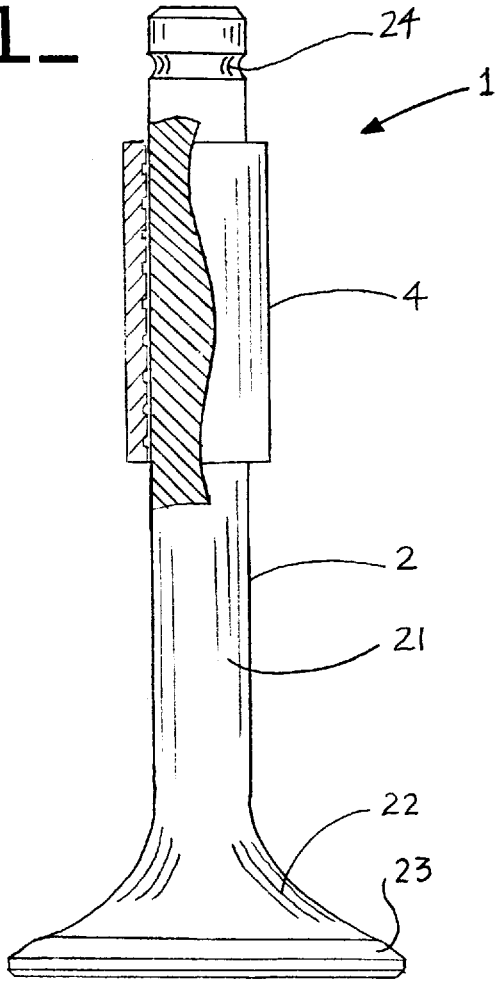
Fig 1 (PRIOR ART)
FIG. 1 is an illustration, in section, of a conventional engine valve/valve guide combination.
Figure 2:
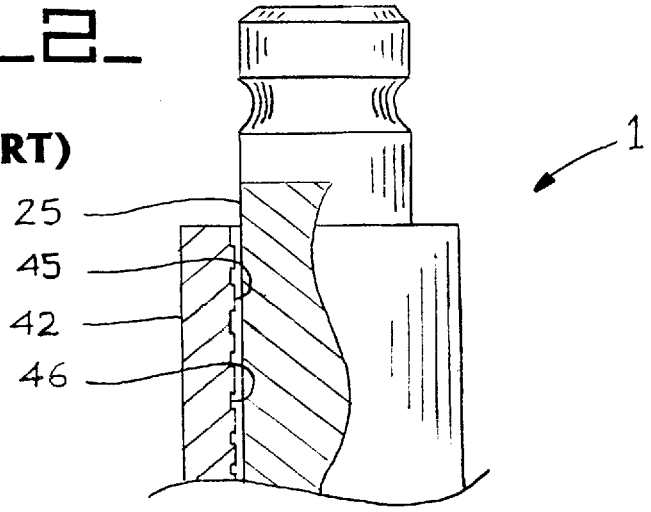
Fig 2 (PRIOR ART)
FIG. 2 is an enlarged view of a portion of the valve/valve guide combination of FIG. 1.
Figure 5:
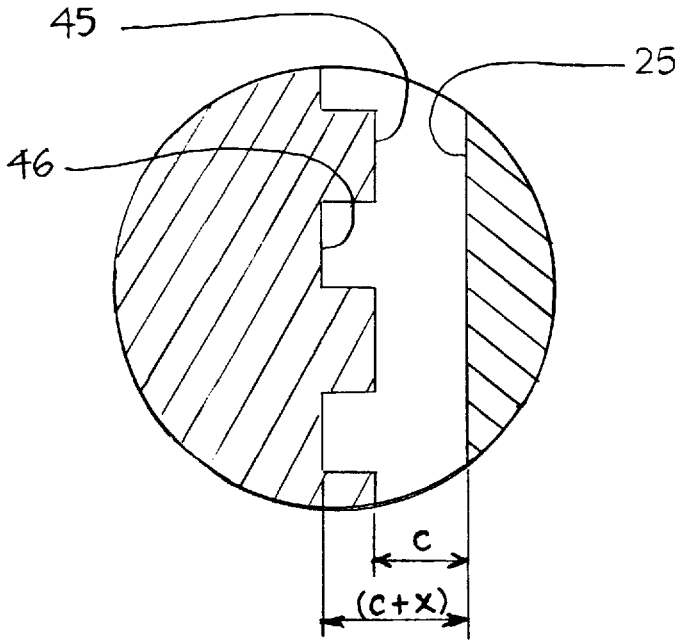
Fig 5 (PRIOR ART)
FIG. 5 is an enlarged view of a portion of FIG. 2, showing the valve stem to valve guide clearance, as in conventional valve/valve guide combinations.

FIGS. 1, 2 and 5 show a conventionally used oil lubricated valve/valve guide arrangement 1, which has a valve 2 and a valve guide 4. Valve 2 has a valve stem 21, an expanded portion 22, an valve seat 23, a valve retainer groove 24 and a valve stem outer surface 25. Valve guide 4 has an outer surface 42, an inner surface 45 and a knurled inner surface 46 having a knurl depth x. As shown in FIG. 5, there exists a valve stem to valve guide radial clearance c between surfaces 25 and 45, and a valve stem to valve guide radial clearance (c+x) between surfaces 25 and 46. Such a conventional arrangement is well known in the industry.

Figure 3:
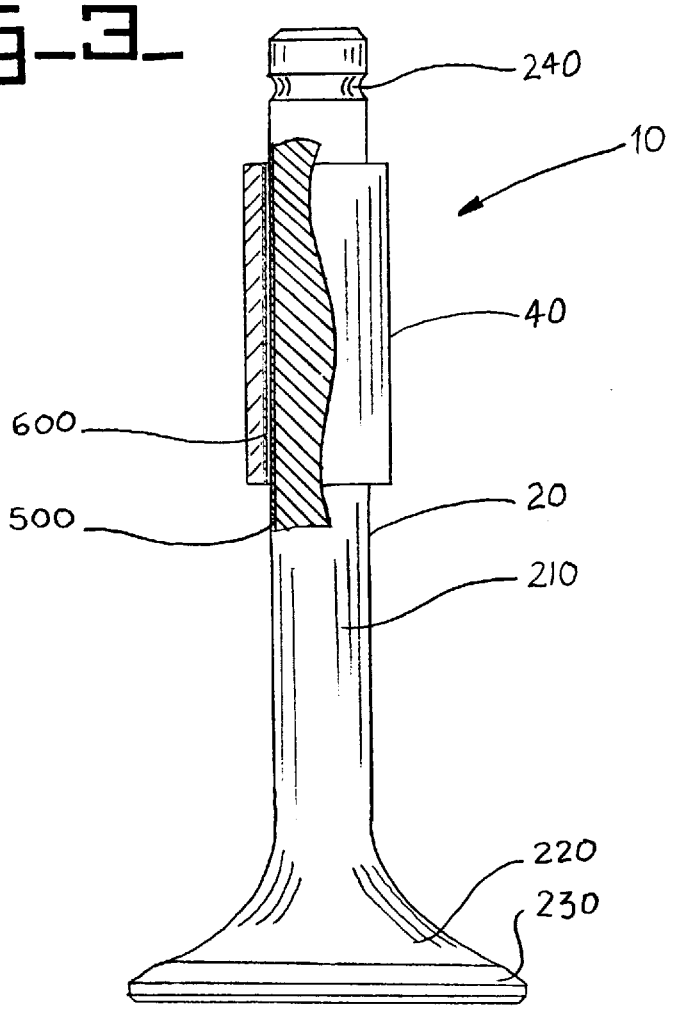
FIG. 3 is an illustration, in section, of the engine valve/valve guide combination according to an embodiment of the present invention.
Figure 4:
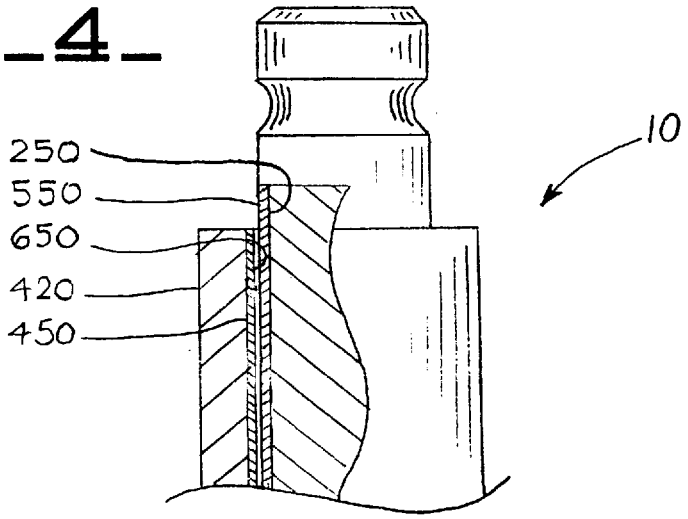
FIG. 4 is an enlarged view of a portion of the valve/valve guide combination of FIG. 3.

Referring to now to FIG. 3 and FIG. 4, in the preferred embodiment of the present invention, a self-lubricated and wear-resistant valve/valve guide combination 10 for an engine comprises (a) a valve guide 40 having a tubular shape, an outer surface 420 and an inner surface 450, (b) a valve 20 having a valve stem 210 and an outer surface 250, (c) a self-lubricating coating 500 and a wear-resistant coating 600.

The self-lubricating coating 500 is deposited desirably on one of a) the inner surface 450 of the valve guide 40, or b) the outer surface 250 of the valve stem 210. The wear-resistant coating 600 is deposited on one of a) the outer surface 250 of the valve stem 210 when the self-lubricating coating 500 is deposited on the inner surface 450 of the valve guide 40, or b) the inner surface 450 of the valve guide 40 when the self-lubricating coating 500 is deposited on the outer surface 250 of the valve stem 210.

Figure 6:
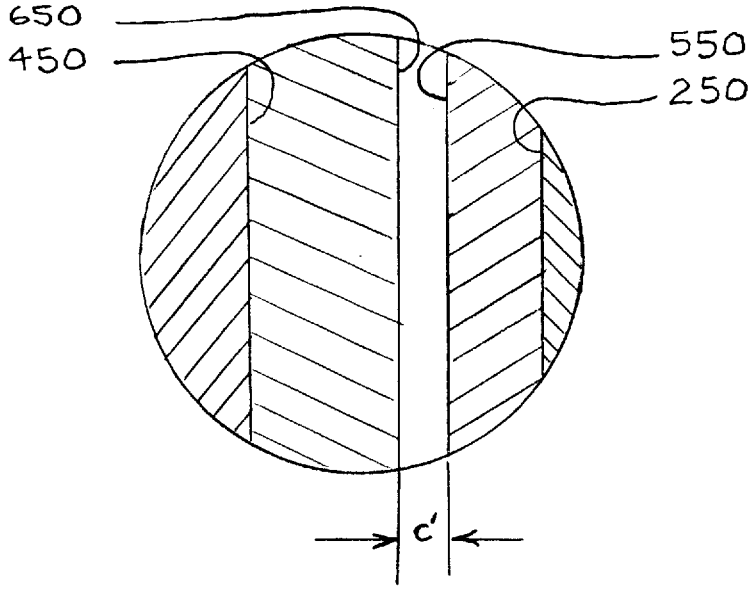
FIG. 6 is an enlarged view of a portion of FIG. 4, showing the valve stem to valve guide clearance, according to the preferred embodiment of the present invention.

Preferably, as shown in FIG. 3 and FIG. 4, the self-lubricating coating 500 is deposited on the outer surface 250 of valve stem 210 and the wear-resistant coating 600 is deposited on the inner surface 450 of the valve guide 40. As shown in FIG. 6, there exists a valve stem to valve guide radial clearance c' between the coated valve stem outer surface 550 and the coated valve guide inner surface 650.

In the preferred embodiment, the coated inner surface 650 of the valve guide is free of knurling. It is desirable to have a smooth bore inner surface of the valve guide which is free of knurling in order to maintain a low stem to valve guide radial clearance and to reduce oil emissions from the engine exhaust into the atmosphere. If the valve guide inner surface is not a smooth bore and is knurled, the knurling causes the effective valve stem to guide radial clearance to be detrimentally excessive and result in undesirable emissions into the atmosphere. The elimination of knurling is also desirable in order to maintain the valve stem to guide clearance in the range of about 0.04 mm (0.00157 inch) to about 0.08 mm (0.003 inch). It is undesirable to have a clearance less than 0.04 mm because too low a clearance will cause excessive wear. Further if the clearance is less than 0.04 mm, during engine operation, the valve stem might get seized within the valve guide due to differences in the thermal expansion characteristics of the respective coatings. It is undesirable to have a valve stem to guide clearance greater than 0.08 mm because it will result in excessive emissions and loss of combustion pressures. Preferably, the valve stem to guide clearance c' between surfaces 550 and 650 is in the range of about 0.05 mm (0.002 inch) to about 0.07 mm (0.0027 inch) and even more preferably, about 0.06 mm (0.0023 inch).

In the preferred embodiment, the coating deposited on the inner surface of the valve guide has a thickness in the range of about 0.254 mm (0.010 inch) to about 0.4 mm (0.0157 inch). Preferably, the coating deposited on the valve guide has a thickness of about 0.38 mm (0.0125 inch). A thickness less than about 0.254 mm is undesirable because it will detrimentally affect the longevity of the valve guide and its self-lubricating or wear-resistant characteristics. A valve guide coating thickness greater than about 0.4 mm is undesirable because it represents a waste of labor and materials.

In the preferred embodiment, the coating deposited on the outer surface of the valve stem has a thickness desirably in the range of about 0.127 mm (0.005 inch) to about 0.254 mm (0.01 inch). Preferably, the valve stem coating thickness is about 0.14 mm (0.0055 inch). It is undesirable to have a valve stem coating thickness less than about 0.127 mm because it will detrimentally reduce one of the self-lubricating or wear-resistant characteristics of the valve stem. It is undesirable to have a valve stem coating thickness greater than about 0.25 mm because it represents a waste of labor and materials.

In the preferred embodiment of the present invention, the self-lubricating coating has a self-lubricating surface and the wear-resistant coating has a wear-resistant surface. When the valve and valve guide combination is assembled, the self-lubricating surface of one of valve stem or valve guide is in sliding engagement with the wear-resistant surface of one of valve stem and valve guide. Although the self-lubricating coating could be deposited on either one of the valve stem or the valve guide, it is preferable to deposit the self-lubricating coating on the valve stem and the wear-resistant coating on the valve guide. This configuration is preferable because it results in the least waste of materials and the best utilization of labor and time.

In the preferred embodiment of the present invention, the self-lubricating coating has a composition by weight consisting essentially of a) a first component, b) a second component and c) a third component. The first component comprises a metal bonded chromium carbide in the range of about 60% to about 80% by weight. It is undesirable to have less than 60% metal bonded chromium carbide because it will result in a detrimental decrease in wear resistance and it is undesirable to have greater than 80% metal bonded chromium carbide because it will result in detrimentally high friction coefficients. The second component comprises a soft, noble metal in the range of about 1% to about 20% and the third component comprises a metal fluoride eutectic in the range of about 5% to about 20%. It is preferable to have a combination of the soft noble metal and the metal fluoride eutectic in the specified weight ranges to have an optimum combination of wear resistance, oxidation resistance and lubrication. A self-lubricating coating such as the one described herein is disclosed in U.S. Pat. No. 4,728,448 issued Mar. 1, 1988 to Sliney. The '448 patent discloses a composite material exhibiting self-lubricating wear and friction reducing properties and the above '448 patent is incorporated herein by reference. Preferably, the self-lubricating coating has a composition by weight consisting essentially of a) the first component in the range of about 65% to about 75%, b) the second component in the range of about 10% to about 18%, and c) the third component in the range of about 12% to about 18%. Preferably, the metal binder in the first component in selected from the group consisting of nickel, cobalt and mixtures thereof, and the metal binder is desirably in the range of about 20% to about 40% by weight of the first component. In the preferred embodiment, the metal binder is nickel and the nickel is present in about 25% by weight of the first component. Preferably, the second component is silver and the metal fluoride eutectic is a barium fluoride, calcium fluoride eutectic. The barium fluoride and calcium fluoride are desirably present in a weight ratio of 62:38 barium fluoride to calcium fluoride respectively.

The wear-resistant coating has a composition by weight consisting essentially of a) chromium in the range about 20% to about 30%, b) nickel in the range of about 5% to about 15%, c) tungsten in the range of about 5% to about 10%, and d) cobalt in the range of about 50% to about 74%. Desirably, chromium in the present in the range of about 22% to about 27%, preferably about 25.5%. Nickel is present in the range of about 8% to about 12% and preferably about 10.5%. Tungsten is present in the range of about 5% to about 10% and preferably about 7.5%. Cobalt is present in the range of about 50% to about 60% and preferably about 56.5%.

In the preferred embodiment, the wear-resistant and self-lubricating coatings are deposited by various known thermal spray techniques such as gas stabilized plasma spray, water stabilized plasma spray, high velocity oxygen-fueled spray and combustion thermal spray. It must be understood that the thermal spray techniques are not limited to the above enumerated methods and that other alternative thermal spray techniques known to those skilled in the art may be employed. For example, plasma spray methods are described in the article titled, "Spray Forming by High Power, High Velocity Plasma Spraying" by M. Scholl, P. Clayton, E. Elmore and J. Wooten, published in the proceedings of the Fourth National Thermal Spray Conference in Pittsburgh, Pennsylvania, May 4–10, 1991, pp. 281–288, which are incorporated herein by reference.

In the preferred embodiment of the method of forming a self-lubricated and wear-resistant valve/valve guide combination for an engine, the method comprises the steps of providing a metal mandrel depositing a first coating on the mandrel, machining the metal mandrel and a portion of the first coating and forming a valve guide, providing a valve having a valve stem, and the valve stem having an outer surface depositing a second coating on the outer surface of the valve stem, locating the valve stem within the valve guide and causing a surface of the wear-resistant coating to be in sliding engagement with a surface of the self-lubricating coating and forming a valve/valve guide combination having a valve stem to guide radial clearance desirably in the range of about 0.04 mm to about 0.08 mm.

In the preferred embodiment of the method of forming a self-lubricated and wear-resistant valve/valve guide, the first coating is selected from one of a) a self-lubricating coating or b) a wear-resistant coating and the second coating is selected from one of a) a wear-resistant coating when the first coating is a self-lubricating coating or b) a self-lubricating coating when the first coating is a wear-resistant coating. It is very important that the coating deposited on the valve stem is not the same as the coating deposited on the valve guide inner surface. Otherwise, failure of the valve/valve guide combination will occur due to the absence of one of either wear-resistant property or lubricating property. Either the valve stem can be deposited with a self-lubricated coating and the valve guide with a wear-resistant coating or vice versa, but preferably the valve stem has a self-lubricating coating and the valve guide has a wear-resistant coating. In the preferred embodiment, the inner surface of the valve guide has a tubular shape and a smooth bore and is free of knurling. Knurling is undesirable because of numerous disadvantages as listed earlier in this specification. Both of the self-lubricating coating and the wear-resistant coating are the same as mentioned previously in this specification.

In the preferred embodiment of the method, a NiCrAly bond coat is deposited on the valve stem prior to deposition of the self-lubricating coating. The NiCrAlY bond coat desirably has thickness in the range of about 0.12 mm to about 0.16 mm. In the preferred embodiment of the method, an outer coat desirably of a steel alloy, and preferably of stainless steel, is deposited on the first coating.

A valve/valve guide assembly was manufactured according to one embodiment of the present invention, as shown below, in illustrative Example A.

EXAMPLE A

The self-lubricating coating used was the PS212 coating developed by NASA and described in U.S. Pat. No. 4,728,448. This coating had a composition by weight percent, 70% nickel bonded chromium carbide, 15% silver and 15% barium fluoride/calcium fluoride eutectic. The wear-resistant coating selected was supplied by Metco Inc., under the trade name Metco 45C-NS Cobalt Alloy Powder, having a composition by weight percent 25.5% chromium, 10.5% nickel, 7.5% tungsten, 0.5% carbon and balance cobalt. The above wear-resistant coating is commonly referred to as Stellite 6.

An exhaust valve of a diesel engine was first coated with a NiCrAlY bond coat by plasma spray. The NiCrAlY bond coat had a thickness of 0.005 inch. The PS212 coating was deposited on the top of the NiCrAlY bond coat. The PS212 coating had a thickness of 0.006 inch. The corresponding valve guide was made in the following manner. A stainless steel mandrel having a diameter about 0.005 inch less than the valve stem outer diameter was selected. The mandrel was plasma sprayed with Stellite 6 coating. The Stellite 6 coating has a thickness of 0.015 inch. A stainless steel coating was deposited by plasma spray on the top of the Stellite 6 coating. The stainless steel coating had a thickness of about 0.030 inch.

Thereafter, the mandrel and a portion of the Stellite 6 coating were removed by machining to result in a valve guide having a smooth inner bore and an inner surface of Stellite 6. The difference between the inner diameter of the coated valve guide and the outer diameter of the coated valve stem was about 0.002 inches, resulting in a radial clearance between the valve stem and valve guide of 0.002 inches when the valve stem/guide was assembled together.

The valve assembly, as described above, was installed in a diesel engine and the engine was run for about 100 hours in a non-externally lubricated and non-cooled environment at an operating temperature of about 300° C. At the end of the test, the valve stem and valve guide were examined. There was no visible surface wear on either the stem or the valve guide even after 100 hours of operation without any external oil lubrication.

INDUSTRIAL APPLICABILITY

The valve stem/valve guide assembly having the self-lubricating and wear-resistant coatings is particularly used for making the intake and exhaust valves and turbocharger wastegate valves for internal combustion engines. This invention is particularly useful for making self-lubricated valve/valve guide assemblies that do not require additional splash lubrication of the area by oil. The present invention results in a lowering of exhaust stream emissions and helps maintain the higher combustion pressures that are encountered in advanced engine designs.

Other aspects, objects and advantages of this invention can be obtained from a study of the disclosure, the drawings and the appended claims.

We claim:

1. A self-lubricated and wear resistant valve/valve guide combination for an engine, comprising:

a valve guide having a tubular shape and an inner surface;

a valve having a valve stem, said valve stem having an outer surface;

a self-lubricating coating deposited on one of (a) said inner surface of said valve guide, or (b) said outer surface of said valve stem;

a wear-resistant coating deposited on one of (a) said outer surface of said valve stem when said self-lubricating coating is deposited on said inner surface of said valve guide, or (b) said inner surface of said valve guide when said self-lubricating coating is deposited on said outer surface of said valve stem;

said self-lubricating coating having a self-lubricating surface, said wear-resistant coating having a wear-resistant surface, said self-lubricating surface is in sliding engagement with said wear-resistant surface when said valve stem is located within said valve guide;

said self-lubricating coating having a composition, by weight, consisting essentially of, (a) a first component, comprising, a metal-bonded chromium carbide in the range of about 60% to about 80%, (b) a second component, comprising, a soft noble metal in the range of about 1% to about 20%, and (c) a third component, comprising, a metal fluoride eutectic in the range of about 5% to about 20%; and said wear-resistant coating having a composition, by weight, consisting essentially of, (a) chromium in the range of about 20% to about 30%, (b) nickel in the range of about 5% to about 15%, (c) tungsten in the range of about 1% to about 10%, and (d) cobalt in the range of about 50% to about 74%.

2. A valve/valve guide combination, as set forth in claim 1, wherein said inner surface of said valve guide is free of knurling.

3. A valve/valve guide combination, as set forth in claim 2, including a valve stem-to-guide radial clearance in the range of about 0.04 mm (0.00157 inch) to about 0.08 mm (0.003 inch).

4. A valve/valve guide combination, as set forth in claim 1, wherein one of said self-lubricating coating or said wear-resistant coating deposited on said inner surface of said valve guide has a thickness in the range of about 0.254 mm (0.010 inch) to about 0.4 mm (0.0157 inch).

5. A valve/valve guide combination, as set forth in claim 1, wherein one of said self-lubricating coating or said wear-resistant coating deposited on said outer surface of said valve stem has a thickness in the range of about 0.127 mm (0.005 inch) to about 0.254 mm (0.010 inch).

6. A valve/valve guide combination, as set forth in claim 1, wherein said self-lubricating coating has a composition, by weight, consisting essentially of, (a) a first component, comprising, a metal-bonded chromium carbide in the range of about 65% to about 75%, (b) a second component, comprising, a soft noble metal in the range of about 12% to about 18%, and (c) a third component, comprising, a metal fluoride eutectic in the range of about 13% to about 17%.

7. A valve/valve guide combination, as set forth in claim 1, wherein said wear-resistant coating has a composition, by weight, consisting essentially of, (a) chromium in the range of about 23% to about 27%, (b) nickel in the range of about 8% to about 12%, (c) tungsten in the range of about 5% to about 10%, and (d) cobalt in the range of about 50% to about 60%.

8. A valve/valve guide combination, as set forth in claim 6, wherein said first component includes a metal binder selected from the group consisting of nickel, cobalt, and mixtures thereof, said metal binder being in the range of about 20% to about 40% by weight of said first component.

9. A valve/valve guide combination, as set forth in claim 8, wherein said metal binder is nickel, said nickel being about 28% by weight of said first component.

10. A valve/valve guide combination, as set forth in claim 6, wherein said second component is silver.

11. A valve/valve guide combination, as set forth in claim 6, wherein said metal fluoride eutectic is a barium fluoride/calcium fluoride eutectic present in a weight ratio of 62:38::$BaF_2$:$CaF_2$.

12. A valve/valve guide combination, as set forth in claim 7, wherein said wear-resistant coating has a composition, by weight, consisting essentially of, (a) about 25.5% chromium, (b) about 10.5% nickel, (c) about 7.5% tungsten, and (d) about 56.5% cobalt.

13. A valve/valve guide combination, as set forth in claim 1, wherein said self-lubricating coating is deposited on the outer surface of said valve stem and said wear-resistant coating is deposited on the inner surface of said valve guide.

14. A valve/valve guide combination, as set forth in claim 13, wherein said valve stem-to-guide radial clearance is 0.06 mm (0.0023 inch).

15. A valve/valve guide combination, as set forth in claim 1, wherein said valve/valve guide is an air intake valve/valve guide for an internal combustion engine.

16. A valve/valve guide combination, as set forth in claim 1, wherein said valve/valve guide is an exhaust valve/valve guide for an internal combustion engine.

17. A valve/valve guide combination, as set forth in claim 1, wherein said valve/valve guide is a turbocharger waste-gate valve/valve guide in an internal combustion engine.

18. A method of forming a self-lubricated and wear resistant valve/valve guide combination for an engine, comprising the steps of:

providing a metal mandrel;

depositing a first coating on said mandrel, said first coating being selected from one of (a) a self-lubricating coating, or (b) a wear-resistant coating, said self-lubricating coating having a composition, by weight, consisting essentially of, (a) a first component, comprising, a metal-bonded chromium carbide in the range of about 60% to about 80%, (b) a second component, comprising, a soft noble metal in the range of about 1% to about 20%, and (c) a third component, comprising, a metal fluoride eutectic in the range of about 5% to about 20%, and said wear-resistant coating having a composition, by weight, consisting essentially of, (a) chromium in the range of about 20% to about 30%, (b) nickel in the range of about 5% to about 15%, (c) tungsten in the range of about 1% to about 5%, and (d) cobalt in the range of about 50% to about 74%;

machining said metal mandrel and a portion of said first coating and forming a valve guide, said valve guide having a tubular shape and an inner surface of said first coating, said inner surface being free of knurling;

providing a valve having a valve stem, said valve stem having an outer surface;

depositing a second coating on said outer surface of said valve stem, said second coating being selected from one of (a) a wear-resistant coating when said first coating is said self-lubricating coating, or (b) a self-lubricating coating when said first coating is said wear-resistant coating;

locating said valve stem within said valve guide and causing a surface of said wear-resistant coating to be in sliding engagement with a surface of said self-lubricating coating; and forming said valve/valve guide combination having a valve stem-to-guide clearance in the range of about 0.04 mm (0.00157 inch) to about 0.08 mm (0.003 inch).

19. A method, as set forth in claim 18, wherein said mandrel has a diameter less than the diameter of said valve stem.

20. A method, as set forth in claim 18, including the step of depositing a NiCrAlY bond coat prior to the step of depositing said self-lubricating coating.

21. A method, as set forth in claim 20, wherein said bond coat has a thickness in the range of about 0.127 mm (0.005 inch) to about 0.152 mm (0.006 inch).

22. A method, as set forth in claim 18, wherein after the step of machining, said first coating has a thickness in the range of about 0.254 mm (0.010 inch) to about 0.4 mm (0.0157 inch).

23. A method, as set forth in claim 18, wherein said second coating is machined to a thickness in the range of about 0.127 mm (0.005 inch) to about 0.254 mm (0.01 inch).

24. A method, as set forth in claim 18, including depositing an outer coat on said first coating, said outer coat being a steel alloy.

25. A method of using a combination of a self-lubricating coating and a wear-resistant coating in a valve and valve guide for an engine, comprising the steps of:

providing a valve guide having a tubular shape and an inner surface free of knurling;

providing a valve having a valve stem, said valve stem having an outer surface;

plasma spraying a first coating on said inner surface of said valve guide, said first coating being selected from one of (a) a self-lubricating coating, or (b) a wear-resistant coating, said self-lubricating coating having a composition, by weight, consisting essentially of, (a) a first component, comprising, a metal-bonded chromium carbide in the range of about 60% to about 80%, (b) a second component, comprising, a soft noble metal in the range of about 1% to about 20%, and (c) a third component, comprising, a metal fluoride eutectic in the range of about 5% to about 20%, and said wear-resistant coating having a composition, by weight, consisting essentially of, (a) chromium in the range of about 20% to about 30%, (b) nickel in the range of about 5to about 15%, (c) tungsten in the range of about 1 to about 5%, and (d) cobalt in the range of about 50% to about 74%;

plasma spraying a second coating on said outer surface of said valve stem, said second coating being selected from one of (a) a wear-resistant coating when said first coating is said self-lubricating coating, or (b) a self-lubricating coating when said first coating is said wear-resistant coating;

locating said valve stem within said valve guide and causing a surface of said wear-resistant coating to be in sliding engagement with a surface said self-lubricating coating; and forming said valve/valve guide combination having a valve stem-to-guide clearance in the range of about 0.04 mm (0.00157 inch) to about 0.08 mm (0.003 inch).

* * * * *